US007765750B2

(12) United States Patent
Duncan

(10) Patent No.: US 7,765,750 B2
(45) Date of Patent: Aug. 3, 2010

(54) RECONFIGURABLE ATTIC AIR VENT

(75) Inventor: Richard S. Duncan, Royersford, PA (US)

(73) Assignee: CertainTeed Corporation, Valley Forge, PA (US)

( * ) Notice: Subject to any disclaimer, the term of this patent is extended or adjusted under 35 U.S.C. 154(b) by 1004 days.

(21) Appl. No.: 11/083,397

(22) Filed: Mar. 18, 2005

(65) Prior Publication Data

US 2005/0160684 A1 Jul. 28, 2005

Related U.S. Application Data

(63) Continuation-in-part of application No. 10/666,657, filed on Sep. 19, 2003, now Pat. No. 7,302,776.

(51) Int. Cl.
*E04B 7/00* (2006.01)
*F24F 7/02* (2006.01)

(52) U.S. Cl. ..... 52/199; 52/95; 454/250; 454/260

(58) Field of Classification Search ..... 52/198, 52/199, 407.3, 95; 454/250, 260
See application file for complete search history.

(56) References Cited

U.S. PATENT DOCUMENTS

| | | | | |
|---|---|---|---|---|
| 2,477,152 A | | 7/1949 | Stevenson | |
| 2,696,356 A | * | 12/1954 | Baumann | 108/51.3 |
| 2,908,464 A | * | 10/1959 | Traudt et al. | 108/51.3 |
| 2,918,242 A | * | 12/1959 | Olivette et al. | 248/544 |
| 3,000,603 A | * | 9/1961 | Hemann | 108/51.3 |
| 3,043,450 A | * | 7/1962 | Conrad et al. | 206/600 |
| 3,302,593 A | * | 2/1967 | Roberts | 108/51.3 |
| 3,543,669 A | * | 12/1970 | Kodaras | 454/296 |
| 3,547,839 A | | 12/1970 | Tocker | |
| 3,580,190 A | * | 5/1971 | Fowler | 108/57.25 |
| 3,862,527 A | | 1/1975 | Peterson | |

(Continued)

FOREIGN PATENT DOCUMENTS

CA 2 159 869 7/2004

(Continued)

OTHER PUBLICATIONS

DiversiFoam, Trade Literature, 4 pages, undated.

(Continued)

*Primary Examiner*—Richard E Chilcot, Jr.
*Assistant Examiner*—Brent W Herring
(74) *Attorney, Agent, or Firm*—Duane Morris LLP

(57) ABSTRACT

Attic vents and methods of their use and manufacture are provided. The air vent of this invention includes an bottom panel member, a pair of side rails and a plurality of support members that connect the bottom to the side rails. The vent is foldable to allow portions of it to lie substantially flat during shipping, and to be deployed at the work site. The foldable configuration allows the vent to be pre-attached to an insulation batt using glue or other fastening means, and then folded and compressed along with the insulation batt for shipping. When deployed at the work site and installed in a roof structure along with the insulation batt, the vent defines at least one channel on the roof facing side thereof, for directing ventilated air from a soffit region of the roof to the roof peak.

29 Claims, 6 Drawing Sheets

U.S. PATENT DOCUMENTS

| | | | | | |
|---|---|---|---|---|---|
| 3,863,553 | A | | 2/1975 | Koontz | |
| 3,911,834 | A | * | 10/1975 | Quaintance | 108/51.3 |
| 3,972,164 | A | | 8/1976 | Grange | |
| 4,007,672 | A | | 2/1977 | Luckey | |
| 4,016,700 | A | | 4/1977 | Blomstedt | |
| 4,096,790 | A | | 6/1978 | Curran | |
| 4,102,092 | A | | 7/1978 | Ward | |
| 4,114,335 | A | | 9/1978 | Carroll | |
| 4,125,971 | A | | 11/1978 | Ward | |
| 4,126,973 | A | | 11/1978 | Luckey | |
| 4,185,433 | A | | 1/1980 | Cantrell | |
| 4,189,878 | A | * | 2/1980 | Fitzgerald | 52/95 |
| 4,197,683 | A | | 4/1980 | Ward | |
| 4,214,510 | A | * | 7/1980 | Ward | 454/260 |
| 4,237,672 | A | | 12/1980 | Peterson | |
| 4,240,358 | A | * | 12/1980 | Munroe | 108/57.2 |
| 4,265,060 | A | * | 5/1981 | Woodhams | 52/95 |
| 4,280,399 | A | | 7/1981 | Cunning | |
| 4,319,529 | A | * | 3/1982 | Beal | 108/51.3 |
| 4,406,095 | A | | 9/1983 | Slavik | |
| 4,446,661 | A | | 5/1984 | Jonsson et al. | |
| 4,581,861 | A | * | 4/1986 | Eury | 52/95 |
| 4,660,463 | A | | 4/1987 | Bottomore et al. | |
| 4,776,262 | A | | 10/1988 | Curran | |
| 4,817,506 | A | * | 4/1989 | Cashman | 454/365 |
| 4,852,314 | A | | 8/1989 | Moore, Jr. | |
| 4,875,419 | A | * | 10/1989 | Helton et al. | 108/56.1 |
| 4,903,445 | A | | 2/1990 | Mankowski | |
| 4,977,714 | A | | 12/1990 | Gregory, Jr. | |
| 5,092,225 | A | * | 3/1992 | Sells | 454/365 |
| 5,094,054 | A | * | 3/1992 | Arends | 52/95 |
| 5,176,090 | A | * | 1/1993 | Roberts et al. | 108/51.3 |
| 5,195,440 | A | * | 3/1993 | Gottlieb | 108/51.3 |
| 5,288,269 | A | * | 2/1994 | Hansen | 454/365 |
| 5,341,612 | A | | 8/1994 | Robbins | |
| 5,361,551 | A | * | 11/1994 | Post | 52/95 |
| 5,370,062 | A | * | 12/1994 | Johnston et al. | 108/51.3 |
| 5,377,600 | A | * | 1/1995 | Speese et al. | 108/51.3 |
| 5,473,847 | A | | 12/1995 | Crookston | |
| 5,483,875 | A | * | 1/1996 | Turecek et al. | 108/51.3 |
| D374,324 | S | * | 10/1996 | Besaw | D34/38 |
| 5,596,847 | A | | 1/1997 | Stephenson | |
| 5,600,928 | A | * | 2/1997 | Hess et al. | 52/309.4 |
| 5,603,258 | A | * | 2/1997 | Besaw | 108/51.3 |
| 5,673,521 | A | | 10/1997 | Coulton | |
| 5,701,827 | A | * | 12/1997 | Urabe | 108/56.1 |
| 5,832,677 | A | * | 11/1998 | Kurttila | 52/95 |
| 6,023,915 | A | | 2/2000 | Colombo | |
| 6,029,582 | A | * | 2/2000 | Ogilvie et al. | 108/51.3 |
| 6,061,973 | A | * | 5/2000 | Accardi et al. | 52/90.1 |
| 6,112,490 | A | * | 9/2000 | Meyer | 52/407.3 |
| 6,346,040 | B1 | * | 2/2002 | Best | 454/260 |
| 6,347,991 | B1 | * | 2/2002 | Bogrett et al. | 454/260 |
| 6,357,185 | B1 | | 3/2002 | Obermeyer et al. | |
| 6,754,995 | B1 | | 6/2004 | Davis et al. | |
| 6,780,099 | B1 | * | 8/2004 | Harper | 454/186 |
| 6,881,144 | B2 | | 4/2005 | Hansen et al. | |
| 6,941,707 | B2 | * | 9/2005 | Sigmund | 52/95 |
| D511,848 | S | | 11/2005 | Ciepliski | |
| 7,000,549 | B2 | * | 2/2006 | Nelson | 108/51.3 |
| 7,007,613 | B2 | * | 3/2006 | Sketo | 108/51.3 |
| 7,094,145 | B2 | | 8/2006 | Rye et al. | |
| 7,234,402 | B2 | * | 6/2007 | Olvey et al. | 108/51.3 |
| 7,426,890 | B2 | * | 9/2008 | Olvey | 108/51.3 |
| 2003/0172851 | A1 | * | 9/2003 | Chen | 108/51.3 |
| 2005/0054284 | A1 | | 3/2005 | Ciepliski et al. | |
| 2005/0072072 | A1 | | 4/2005 | Duncan et al. | |
| 2006/0105699 | A1 | | 5/2006 | Kortuem et al. | |
| 2006/0213142 | A1 | * | 9/2006 | Albracht | 52/543 |
| 2006/0248855 | A1 | * | 11/2006 | Olvey | 52/782.1 |

FOREIGN PATENT DOCUMENTS

| | | |
|---|---|---|
| CA | 2 482 054 | 3/2005 |
| CA | 2 501 920 | 9/2005 |
| CA | 2 320 590 | 11/2005 |
| GB | 2 145 756 A | 4/1985 |

OTHER PUBLICATIONS

Architectural West, "Ventilation A Well-Designed Roof Benefits from What's Below", May/Jun. 2004, p. 26-29.
Owens-Coming/Perma-R, Trade Literature, 1 page, undated.
DiversiFoam, Trade Literature, 1 page, undated.
Apache, Trade Literature, 1 page, undated.
ADO Products, Trade Literature, 1 page, undated.
Meyer, Trade Literature, 1 page, undated.
Practiv/Tenneco, Trade Literature, 1 page, undated.
Johns-Manville, Trade Literature, 1 page, undated.
Shelter Enterprises, Trade Literature, 1 page, undated.
Moore Products, Trade Literature, 1 page, undated.
Owens-Corning, RAFT-R-MATE® , Attic Rafter Vents, Trade Literature, 1 page, Sep. 27, 2006.
Owens-Corning, FoamulaR, Trade Literature, 2 pages, Feb. 1999.

* cited by examiner

RECONFIGURABLE ATTIC AIR VENT

CROSS REFERENCE TO RELATED APPLICATIONS

The present invention is a continuation-in-part of U.S. application Ser. No. 10/666,657, filed on Sep. 19, 2003, now U.S. Pat. No. 7,302,776, by Duncan et al., titled "Baffled Attic Vent and Method of Making Same," the entirety of which is incorporated herein by reference.

FIELD OF THE INVENTION

This invention relates to air vents installed between adjacent roof rafters of a structure, and particularly to foldable air vents that can be packaged integrally with insulation batt material.

BACKGROUND OF THE INVENTION

With an increasing emphasis on energy efficiency, attic insulation has often been supplemented by blown, loose-fill insulation, or by additional or thicker insulation bats to prevent heat loss in the winter and cool air loss in the summer. Unfortunately, thicker attic insulation can lead to poor air circulation when the spaces between the roof joists and the top wall plate of the building are closed or obstructed. These spaces must be left open to provide air flow between the soffit area and the attic space, for reducing excess humidity and heat, which have been known to deteriorate roofing and structural components. In order to keep this area open, attic vents have been used.

The purpose of an attic vent is to prevent installed insulation, such as fiberglass bats, blankets, fiberglass and cellulose loose fill, from blocking the natural air flow from the ventilated soffit up through to the roof ridge vent or gable vents in the attic. Several attic vents have been designed for this purpose. See, for example, U.S. Pat. No. 4,007,672 directed to a perforated block-style vent, U.S. Pat. No. 4,125,971 directed to a flat panel formed on site into an arch; U.S. Pat. No. 4,126,973 directed to a perforated block-style vent; U.S. Pat. No. 4,197,683 which is directed to the use of a vent board attached in the A-plane of a header board; U.S. Pat. No. 4,214,510 directed to a rolled sheet design; U.S. Pat. No. 5,341,612 directed to the use of a longitudinal ridge in a roof vent for compressive stiffness; U.S. Pat. No. 5,596,847 directed to a vent having an integral transverse stiffening element integrated in the bottom offset wall; U.S. Pat. No. 5,600,928, directed to a vent having stiffeners in the form of saddles in the longitudinal ridges of the roof plane and gussets between offset, bottom surface and the inclined walls of the channel; U.S. Pat. No. 6,347,991, directed to a vent having an integral hinge in a transverse direction, about 4-6 inches from one end; U.S. Pat. No. 6,346,040, directed to an integral vent and dam folded on-site from a flat sheet; and U.S. Pat. No. 6,357,185, directed to a vent having a sealable panel between the bottom of the and the top of the header.

In addition, there are many commercial attic vents that are available for this purpose: PERMA-R® from Owens-Corning; CERTIVENT® from Diversifoam, Inc. A simple foam available from Apache Products; DUROVENT® available from ADO Products; PROVENT® from an unnamed source; and products available from Pactiv; AEROVENT® from Shelter Enterprises, Inc.; and POLYVENT PLUS® from Moore Products, LLC.

Most of the above mentioned patented or commercial vents are vacuumed-formed extruded polystyrene foam. These designs provide for an open air flow area required by most building codes, while providing the stiffness to resist collapsing when the insulation is installed.

The use of such pre-formed vents requires that the vent and insulation be provided as separate pieces, since the insulation batts are typically packaged compressed for packaging so as to reduce the insulation package size for shipping and storage. At the work site, the installer typically nails or staples the vent to the roof structure before the insulation is installed. As a result, the installer may forego installation of the vent (either inadvertently or otherwise) or may install fewer vents than is desirable to provide optimal venting of the roof structure. Proper installation of vents is particularly important in cathedral ceiling applications, in which every rafter bay is individually insulated, and where the insulation vents should be installed along the entire length of the roof.

Accordingly, there is a need for an attic air vent that can be reconfigurable from a relatively flat to a deployed configuration for compact storage and transport. There is also a need for a reconfigurable attic air vent which can be attached to the insulation material during manufacture and compressed along with the insulation batt for packaging, shipping and storage, and which can later be installed with the insulation material in a single step to provide a desired insulation path between the roof soffit and roof peak.

SUMMARY OF THE INVENTION

A vent is disclosed for use in maintaining a space between insulation material and a roof structure. In one embodiment, the vent includes a bottom panel having first and second sides and a longitudinal axis, a pair of longitudinally disposed first and second side rails, and a plurality of support legs associated with each side rail. Each support leg can have first and second ends, with the first end connected to one side of the bottom panel and the second end being connected to one of the side rails. The support legs can be connected to the bottom panel and side rails along respective fold lines so that the vent has a flattened configuration in which the top surfaces of the bottom panel, support legs and side rails are all substantially parallel to one another other, and a deployed configuration in which the top surfaces of the bottom panel and side rails are substantially parallel to one another and are substantially non-parallel to the top surfaces of the support legs.

An insulation product including a vent and an insulation member is also disclosed. The vent can comprise a bottom panel having first and second sides and a longitudinal axis, a plurality of support legs, and a pair of longitudinally disposed first and second side rails. In one embodiment, the vent is fixed to the insulation member along at least a portion of the bottom panel.

In another embodiment, an attic vent for ventilating air under a roof between a soffit area of said roof and an attic space is provided. The vent is configured to form a duct with an attic facing side of said roof, and can include a bottom panel having first and second sides and a longitudinal axis, a pair of longitudinally disposed first and second side rails, and a plurality of support legs associated with each side rail. Each support leg can have a first end foldably associated with one of the first and second sides and a second end foldably associated with one of the first and second side rails. The foldable support legs allow the vent to assume a flat configuration in which top surfaces of the support legs, side rails or flanges and a portion of the bottom panel are all substantially parallel to each other, and a deployed configuration in which the top surfaces of the bottom panel and side rails or flanges are substantially parallel to one another while being substantially non-parallel to the top surface of each of the support legs.

A method of providing a ventilation path between an insulation member and a roof structure is also provided. The method can include the steps of (a) providing an insulation batt having a roof facing surface, an attic facing surface, and a longitudinal axis; (b) providing a ventilation device having a bottom panel, a pair of longitudinal side rails or flanges, and a plurality of support members disposed between the bottom panel and each side rail, each of the support members further having a first end foldably connected to one of the side rails and a second end foldably connected to the bottom panel; (c) fixing the bottom panel of the ventilation device to the roof facing surface of the insulation batt; and (d) installing the insulation batt and ventilation device between a pair of rafters adjacent the roof structure so that the ventilation device forms a duct with the attic facing side of the roof.

A foldable attic vent for maintaining a space between an insulation material and a roof structure is also disclosed. The vent can comprise a bottom panel having first and second sides, a longitudinal length and a planar surface thereon. The vent can also have first and second flanges for engaging the attic side of said roof structure, said first and second flanges disposed laterally from said bottom panel and connected thereto by at least first and second support legs, respectively. Thus configured, the vent can be provided in a first position, whereby said planar surface, flanges and support legs are approximately located within a common plane. The vent can further be reconfigurable to a second position whereby said first and second support legs are folded upwardly from said common plane to present said first and second flanges in a higher plane which is substantially parallel with said common plane when said attic vent is installed.

BRIEF DESCRIPTION OF THE DRAWINGS

The accompanying drawings illustrate preferred embodiments of the invention so far devised for the practical application of the principles thereof, and in which.

DETAILED DESCRIPTION OF THE INVENTION

This invention is directed to attic air vents used under the roof of a building to ventilate air from a soffit area to an attic space. The invention is particularly advantageous for use in cathedral ceiling applications in which pre-formed insulation batts are placed between roof rafters. Pre-formed insulation batts can be self-retaining, meaning they are manufactured to have a width that is from ¼" to ½" wider than the distance between adjacent roof rafters. The resulting friction-fit between the batts and roof rafters eliminates the need for stapling or other mechanical fastenings. One problem with such self-retaining insulation batts is that without careful installation they can be pressed up too close to the roof, thereby cutting off air flow from the soffit to the roof peak.

Figure 1:
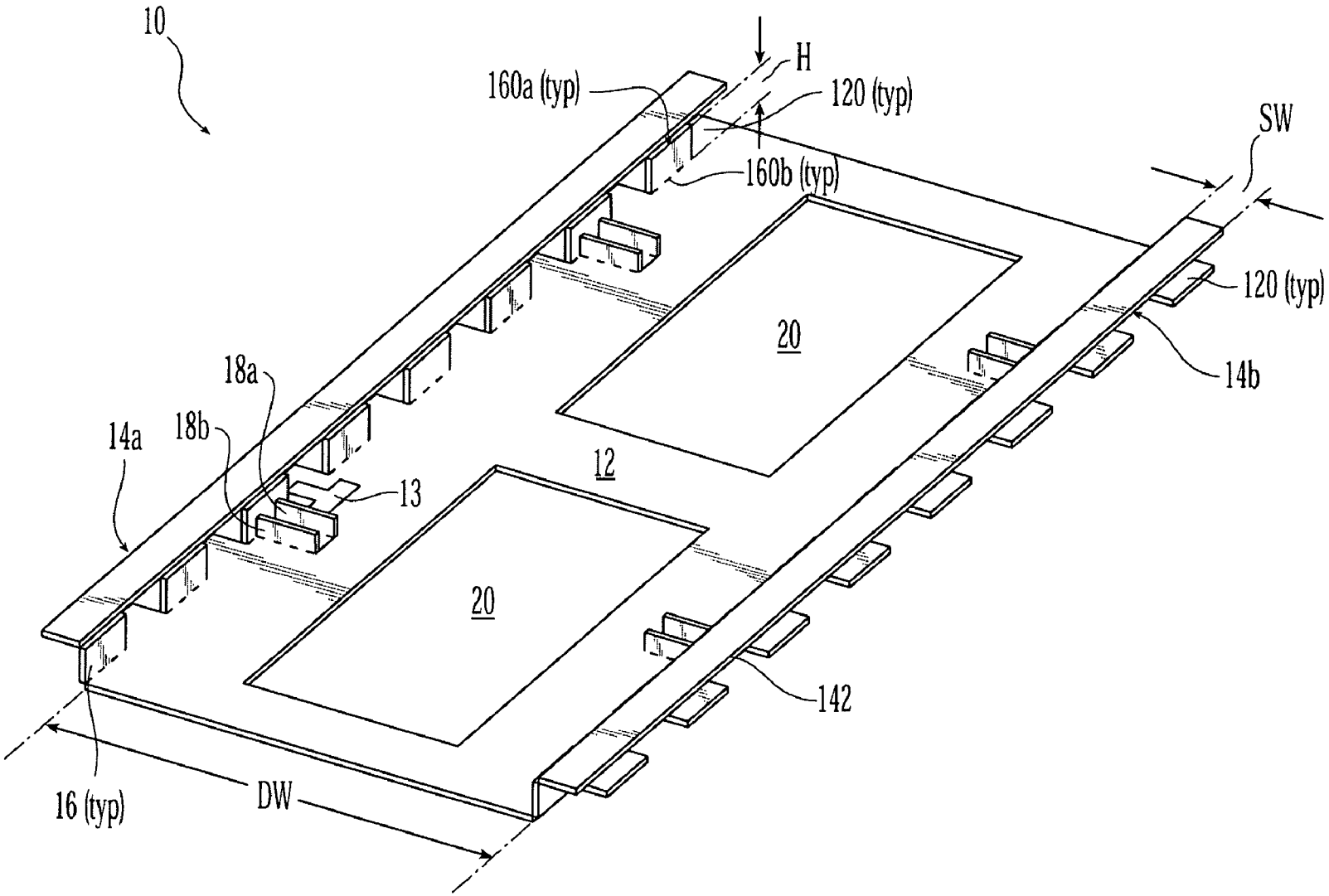
FIG. 1 is a perspective view of the vent of the present invention.
Figure 2A:
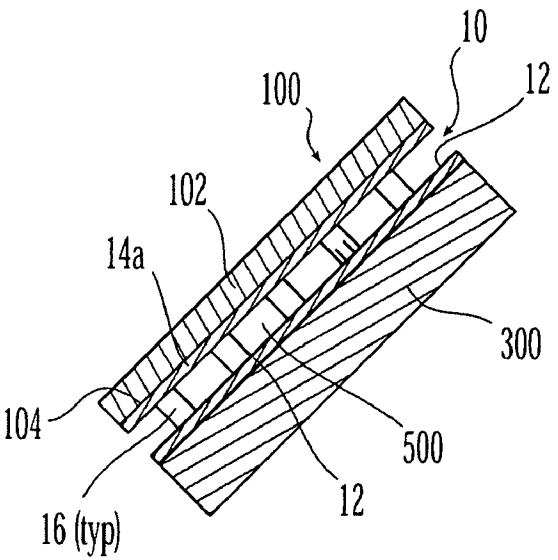
FIG. 2 is a side section view of the vent of FIG. 1 installed between a roof structure and insulation material.
Figure 2:
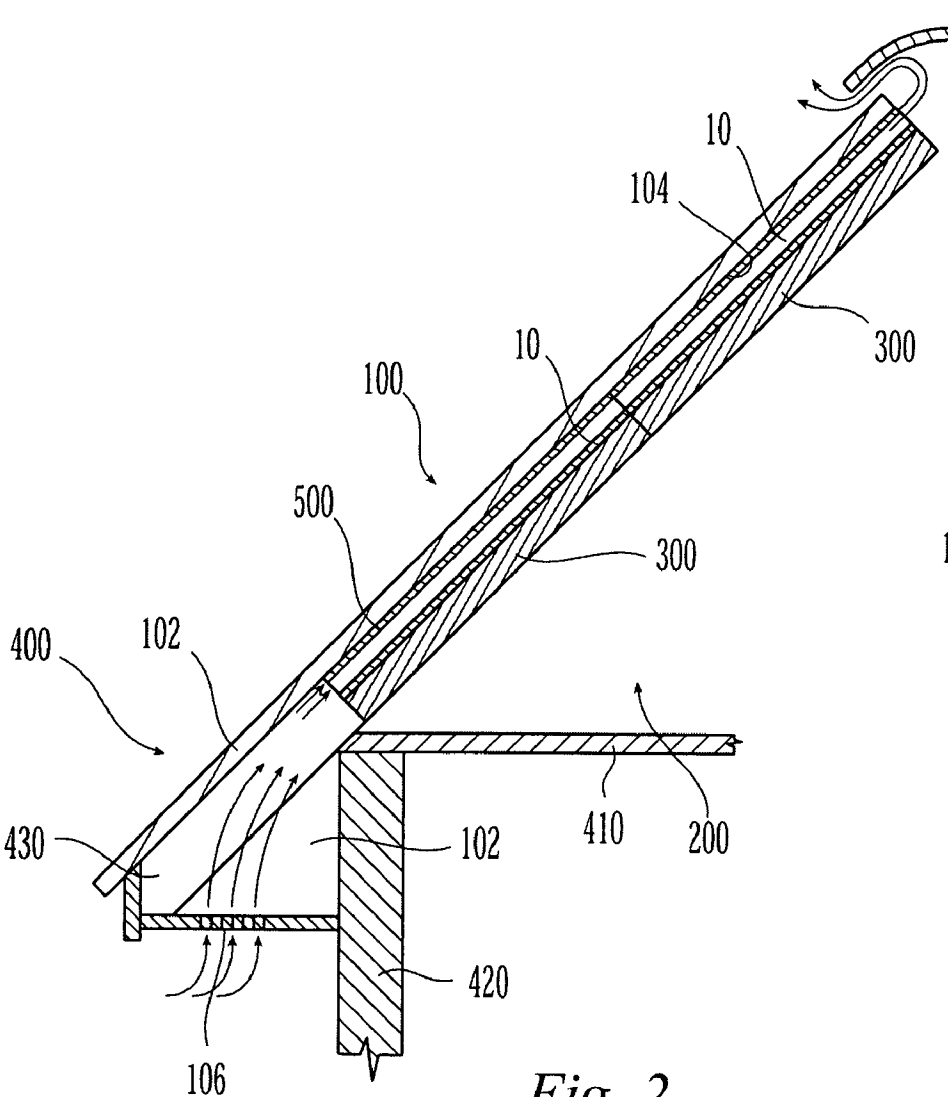

In accordance with the Figures, and particularly FIGS. 1 and 2, there is shown a preferred vent 10 for ventilating air under a roof 100 between a soffit area 102 of the roof and a roof peak 440. The vent 10 includes a bottom panel 12 for engaging the insulation material or batt 300, and an offset pair of side rails or flanges 14*a, b* for engaging the attic side 104 of the roof 100. The side rails 14*a, b* are connected to the bottom panel 12 via a plurality of support legs 16 which are sized to provide a predetermined offset height "H" between the panel and the rails, thus providing a desired ventilation space (i.e. a duct) between the insulation batt 300 and the attic side 104 of the roof upon installation. The support legs 16 connect to the bottom panel 12 and the side rails 14*a, b* via respective longitudinal fold lines 160*a, b*, thus allowing the vent 10 to be manufactured from a single flat sheet of material (see FIG. 3) which can then be folded into the deployed structural configuration illustrated in FIG. 1 simply by pulling the side rails 14*a, b* out and away from the bottom panel 12. The flat sheet design simplifies manufacture and packaging/shipping as compared to standard pre-formed molded vents. One or more locking tabs 18*a, b* can be provided for each side rail 14*a, b* to maintain the rails in the deployed configuration, thus preventing the vent 10 from collapsing during installation. Since the side rails 14*a, b* impinge the inside of the rafters to which they are applied, additional means for securing the rails 14*a, b* laterally from the central or bottom panel 12 are unnecessary, but nevertheless could be provided, by, for example a "T"-shaped locking tab 13 that can be popped out of the central panel 12 and inserted through an opening between support legs 16 to retain the rails 14*a, b* upright, before the vent is installed.

In use, the installer can unpack the vent 10, which will either be pre-attached to an insulation batt 300 at the factory or will be provided separately, but in either case will be provided in a flattened configuration. If the vent 10 is pre-attached to the insulation batt, it will typically be folded into the configuration shown in FIG. 7, which allows it to be packed and compressed along with the batt 300 for shipping. If the vent 10 is not pre-attached to the batt, it can either be folded into the configuration of FIG. 7 before packaging, or it can be maintained in the flattened state of FIG. 3. In either case, a plurality of vents 10 can be stacked up and packaged for compact storage and shipping.

To deploy the vent the installer simply grasps the side rails 14*a, b* and pulls them out and away from the bottom panel 12, at the same time folding the associated support legs 16 along fold lines 160*a, b*, so that the vent assumes the deployed configuration of FIG. 1. Locking tabs 18*a, b* can then be folded upward to maintain the vent 10 in the deployed configuration and to prevent collapse of the vent 10 during installation. For the configuration in which the vent 10 is pre-attached to the insulation batt 300, the installer need only place the batt and vent between a targeted pair of rafters and press the batt upward until a slight resistance is felt as the side rails 14*a, b* of the vent engage the attic side of the roof. The bottom panel 12 of the vent 10, thus installed, forms a duct with the attic side 104 of the roof to provide the desired ventilation path. For the configuration in which the vent is provided separately from the batt, the installer can either install the vent between the rafters first, or can glue or otherwise fix the vent to the batt, and then install the two together as previously described.

Figures 3, 3A:
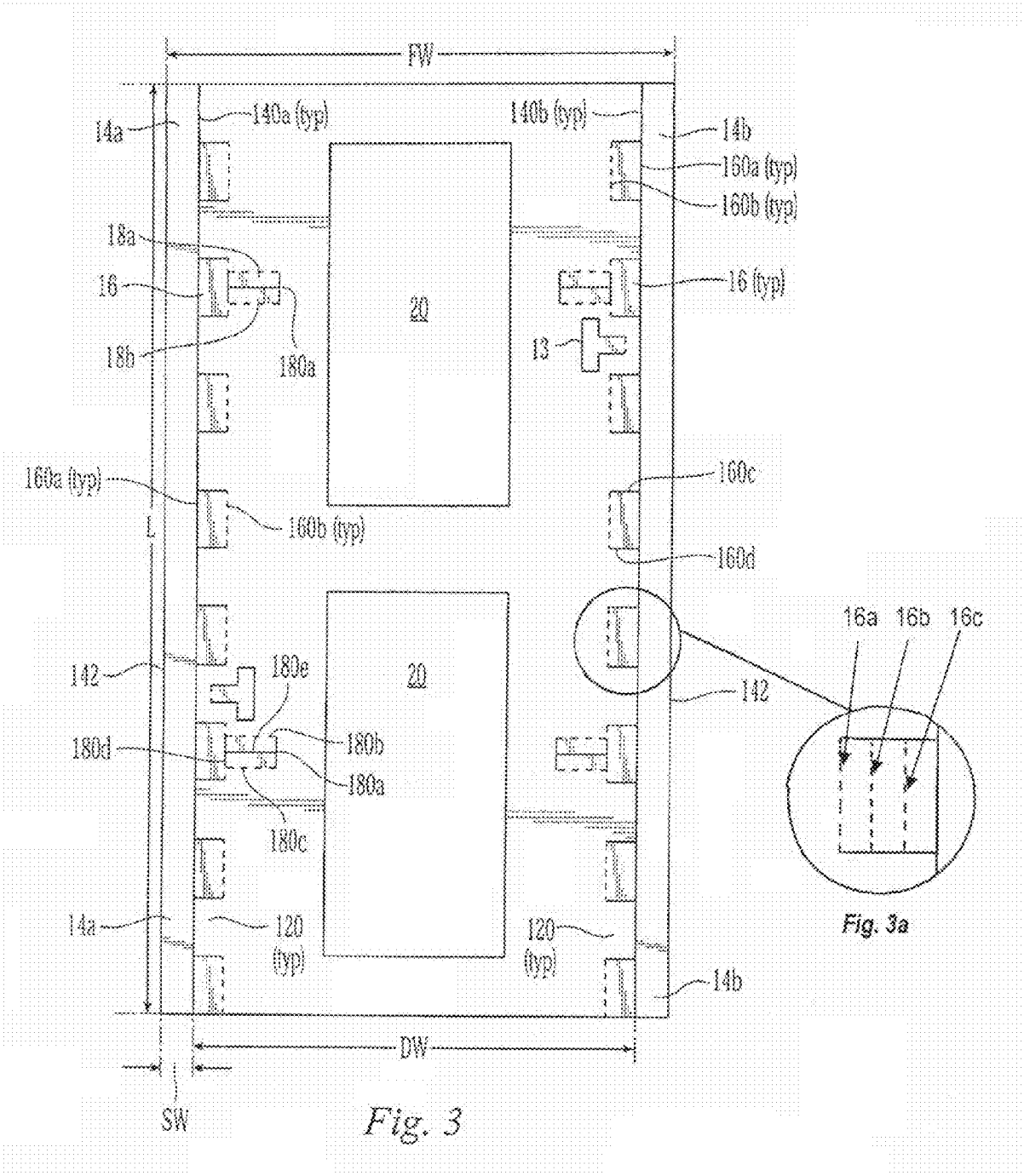
FIG. 3*a* is a detail view of an embodiment of the vent of FIG. 1 showing a support member incorporating an adjustable offset height feature.

Referring in more detail to FIG. 3, the vent 10 is shown in the flat configuration, with cut lines shown as solid lines and fold lines shown as dashed lines. The vent 10 can be manufactured from a single sheet of material, with the resulting individual pieces being foldable with respect to each other to form the deployed vent 10 of FIG. 1. As can be seen in FIG. 3, a variety of cut lines and perforation lines are provided to form side rails 14*a, b*, support members 16 and locking tabs 18*a, b*.

Furthermore, at least one opening 20 can be provided in the bottom panel 12 to facilitate the passage of moisture from the insulation batt to the duct space 500 (FIG. 2) formed by the bottom panel 12 and the attic side 104 of the roof 100. This opening is advantageous because, during normal use, moisture from the attic space can pass through the attic drywall and accumulate in the insulation batt. With opening 20, a path is created that allows the otherwise accumulated moisture to escape into the duct space 500 and be carried out the vent at the peak 440 of the roof.

Referring again to FIG. 3, the vent 10 is provided with a series of intermittent and longitudinally oriented cuts 140*a, b* that separate the side rails 14*a, b* from the bottom panel 12. These cuts 140*a, b* are spaced inward from the outside lateral edge 142 of the side rails 14*a, b* by a dimension "SW" to form side rails having a width of the same dimension. In one embodiment, "SW" is about 1.5 in., although this dimension is not critical and side rails of any appropriate width can be used.

A series of intermittent and longitudinally oriented perforations 160*a* define the fold lines between the support members 16 and the side rails 14*a, b*, and a parallel series of perforations 160*b* define fold lines between the support members 16 and the bottom panel 12. Transversely oriented cuts 160*c, d* are provided between each set of parallel perforations 160*a, b* to form the individual support members 16. Thus formed, the side rails 14*a, b* are longitudinally foldable with respect to the support members 16 along perforations 160*a*, and the support members 16 are longitudinally foldable with respect to the bottom panel 12 along perforations 160*b*. These cut and fold lines allow the vent to be reconfigured from the flat configuration of FIG. 3 to the deployed configuration of FIG. 1, simply by folding the side rails, support members and bottom panel 12 along the perforations. This series of fold lines provides a simple yet effective arrangement for forming the vent 10 of the invention.

The perforations 160*a, b* can be sized and configured to provide a plurality of individual support members 16 having desired dimensions of length and width. Since it is the support members that provide the offset between the side rails 14*a, b* and the bottom panel 12 when the vent is in the deployed configuration, adjusting the size of the support members adjusts the offset height "H" between the panel and the rails to thus provide a desired ventilation space (i.e. a duct) between the insulation batt 300 and the attic side 104 of the roof upon installation. In one embodiment, the side rails 14*a, b* are sized to provide an offset height "H" of about 1.5 in, which represents a gap of about the same amount between the insulation and the attic side 104 of the roof 100. A 1.5 in offset height "H" between the insulation and the roof is desirable for rafter lengths up to about 30 to 35 feet. Longer rafter lengths can warrant an offset "H" of about 2 in. to 3 in. Such increased size gaps can easily be provided simply by increasing the distance between perforations 160*a, b* by an amount equal to the desired incremental increase in offset.

At least one pair of locking tabs 18*a, b* can be provided for each side rail 14*a, b* to maintain the vent 10 in the deployed configuration and to prevent the vent from collapsing during installation. As can be seen in FIGS. 1 and 3, the locking tabs 18*a, b* are formed as part of the bottom panel 12, and are separated from the panel 12 along longitudinal cut lines 180*a, d* and laterally oriented perforations 180*b, c*. The tabs are also freed from each other by laterally-oriented cut line 180*e*.

When the vent 10 is configured in the deployed configuration so that support members 16 are oriented substantially perpendicular to bottom panel 12, the tabs 18*a, b* themselves can be deployed by folding along their respective lateral perforations 180*b, c* upward, away from each other in a "French Door" fashion as shown in FIG. 1. In this configuration, the portion of each tab formed by longitudinal cut line 180*d* abuts the top surface of the associated support member 16, thus preventing the support member from folding inward toward the bottom panel 12. This locking feature ensures that when the vent 10 and insulation batt 300 are inserted between rafters and pressed up into engagement with the roof, that the vent does not collapse in upon itself.

It is noted that although the illustrated embodiment describes a pair of tab members 18*a, b* associated with each of two individual support member 16, any number and arrangement of tab members can be provided.

Further, although the openings 20 in the bottom panel 12 are shown as being generally rectangular in shape, any appropriate size and/or shaped opening may be used (e.g. punched holes, slits, etc. Likewise, at least a portion of the bottom panel 12 could be made of a breathable material, thus eliminating the need for stamping or cutting individual openings.

As previously noted, insulation batts of the type used between roof rafters can be designed to be self-retaining. Thus, the batt can be manufactured to be about ¼" to ½" wider than the expected distance between adjacent rafters. Prior to installation, the user simply applies a lateral compression force to the batt and slides it between the rafters. When the batt is released it springs back to forms a friction fit with the rafters. For embodiments of the invention in which the vent 10 is pre-affixed to the batt, the vent 10 enhances this self-retaining feature by increasing the lateral stiffness of the batt. As can be seen in FIGS. 1-3, between the plurality of individual support members 16 are formed a series of laterally-extending projections 120. When the vent is fixed to the batt 300, these laterally-extending projections 120 extend out to the very edges of the batt. As such, the entire width of the batt is covered by an additional material thickness comprised of the bottom panel portion 12 and the projections 120. As a result, when the vent and batt are fixed together, laterally compressed and inserted between adjacent roof rafters, a greater expansion force is exerted back out against the rafters, thus resulting in a stronger friction fit and better in-place retention of the batt and vent.

The vent 10 can be cut or stamped from a single sheet of material to create the separations and fold lines desired to produce the vent of FIG. 1. It should be noted that although the vent 10 has been described as being formed from a single sheet or piece of material, it could alternatively be formed from multiple pieces of material glued or otherwise formed together. Further, although the fold lines have been described as being perforated, other methods of inducing a fold line can be provided, such as scoring or cutting a portion of the material thickness.

The air vent 10 can be manufactured from cardboard, sheet plastic and foamed plastic, such as polyurethane or polyolefin foam, and most desirably, extruded polystyrene (XPS) foam. Suitable flame resistant materials, such as trisphosphate, hexabromocyclododecane, or equivalent material can be added to the base material. In a preferred embodiment, the vent 10 is manufactured from XPS foam, which is impervious to moisture, and which resists formation of mold and mildew.

The vent 10 can be manufactured by stamping, cutting, molding or any other suitable method known in the art for providing a vent structure that can be folded from a substantially flat state to a deployed state to provide desired ventilation air flow between an insulation batt and a roof structure.

Figure 7:
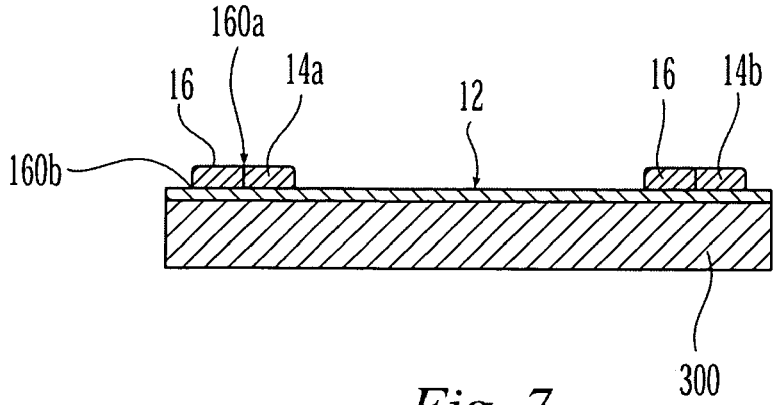
FIG. 7 is an end view of the vent of FIG. 1 adhered to an insulation batt and configured in a packaged state.

In the illustrated embodiment, the vent 10 has a flattened width "FW" of about 25.5 inches (in) and a length "L" of about 48 in. These dimensions allow the vent to substantially conform to a standard preformed insulation batt 300 when the vent is deployed. Such sizing is advantageous because it allows the vent and batt to be connected to one another during the manufacturing process, so that the two may be packaged, shipped, and installed together, which can increase the ease of installation as well as reduce the chance for installation error due to selection of an improper vent or where no vent is installed at all. While such pre-assembly is an advantage, it is not critical, and thus the two pieces may be provided separately to the installer. The vent and batt may thereafter be glued or otherwise fixed together at the job site prior to installation using known methods and materials. Alternatively, the vent and batt may be installed without the need for gluing or fixing the pieces together.

Where the vent is connected to the batt during manufacture, the vent can be folded into the configuration shown in FIG. 7. This allows the vent 10 to conform to the footprint of the insulation batt so that the assembled vent and batt will fit within the packaging envelope used for the insulation material.

Figure 8A:
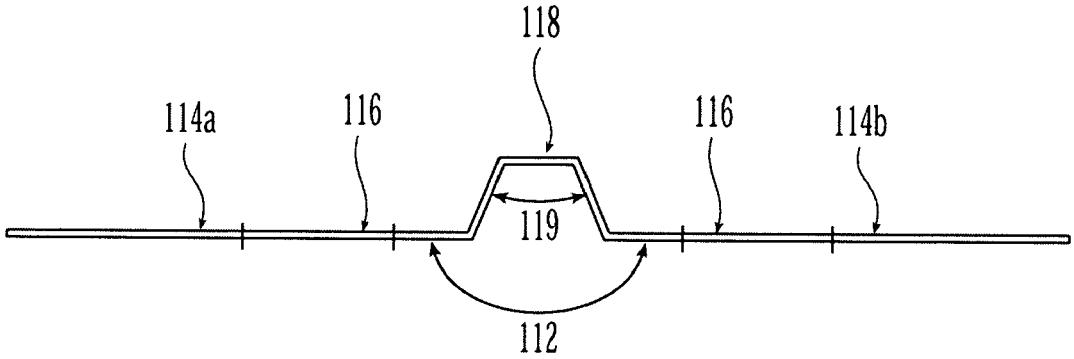
FIGS. 8A and 8B are end views of an alternative vent in flattened and deployed configurations, respectively.
Figure 8B:
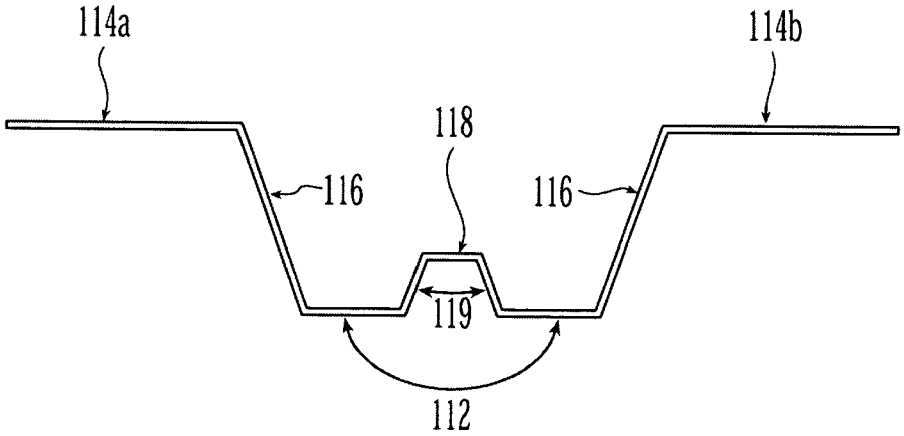

Referring to FIGS. 8*a* and 8*b* air vent longitudinal rib 118 is provided along a central portion of the vent 10 to provide longitudinal support. Thus, the vent 10 can have a "W" shaped cross section including side rails 114*a, b* and support members 116. The rib 118 can be generally centrally located in bottom panel portion 112 and can have a pair of side walls 119 that can each form an oblique angle with respect to the bottom panel portion 112. As can be seen in FIG. 8*a*, the vent 10 can be provided (i.e. shipped) in a partially flattened condition, from which it can be folded into the deployed configuration of FIG. 8*b* for installation between a targeted pair of ceiling rafters.

Figure 4:
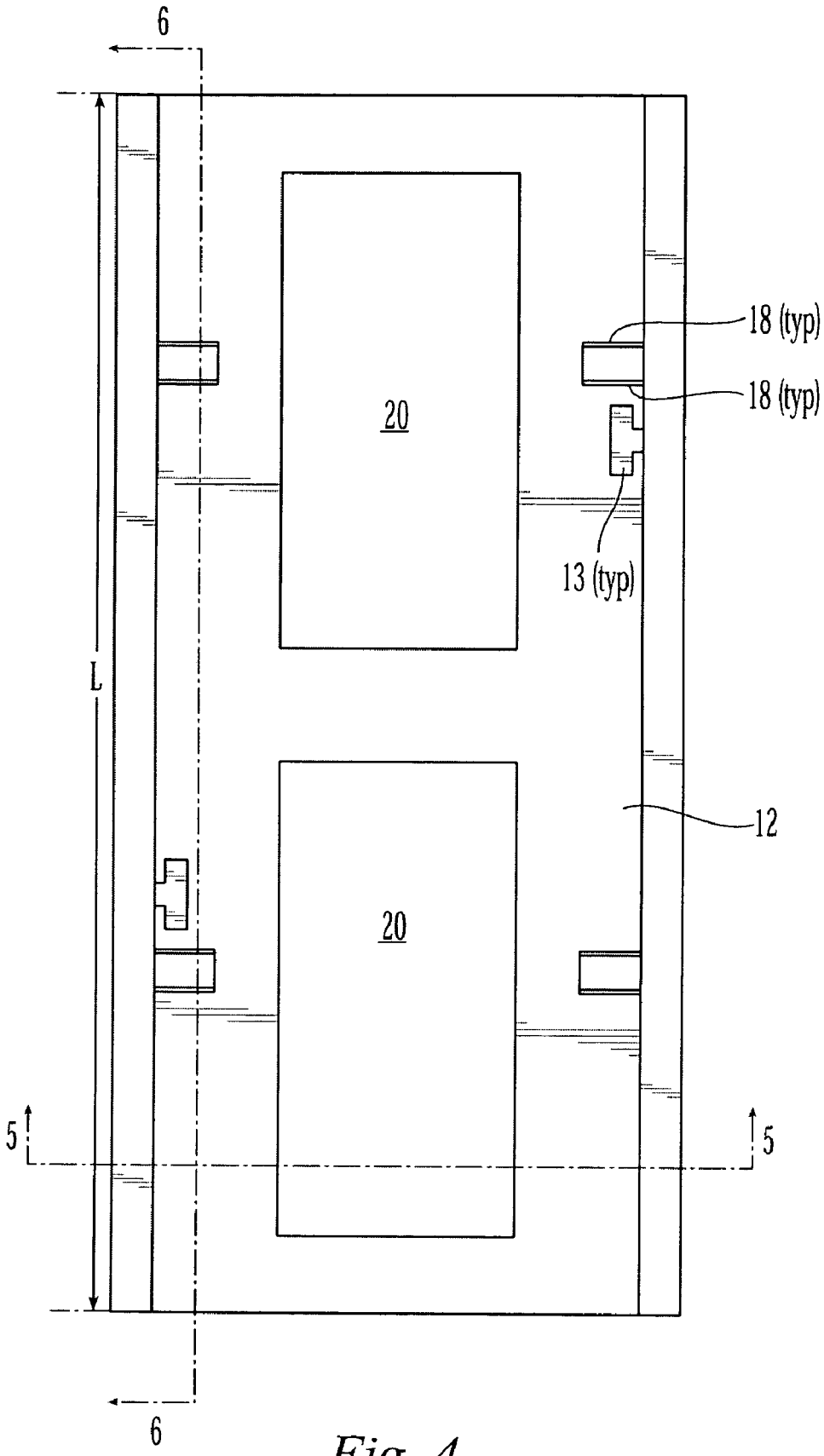
FIG. 4 is a top view of the vent of FIG. 1, showing the vent in the deployed state.

Referring to FIG. 4, the vent 10 is shown in the deployed configuration. Locking tabs 18*a, b* are also shown in their extended, locked position. In the illustrated embodiment, the vent 10 has a deployed width "DW" of about 22.5 in. which, as previously noted, allows the vent to substantially conform to conform to the footprint of a standard preformed attic insulation batt 300.

Figure 5:
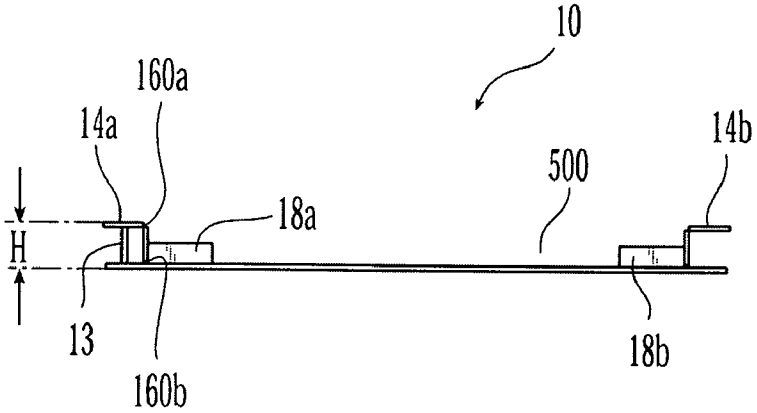
FIG. 5 is a cross-section view of the vent of FIG. 1, taken along line 4-4 of FIG. 4.
Figure 6:
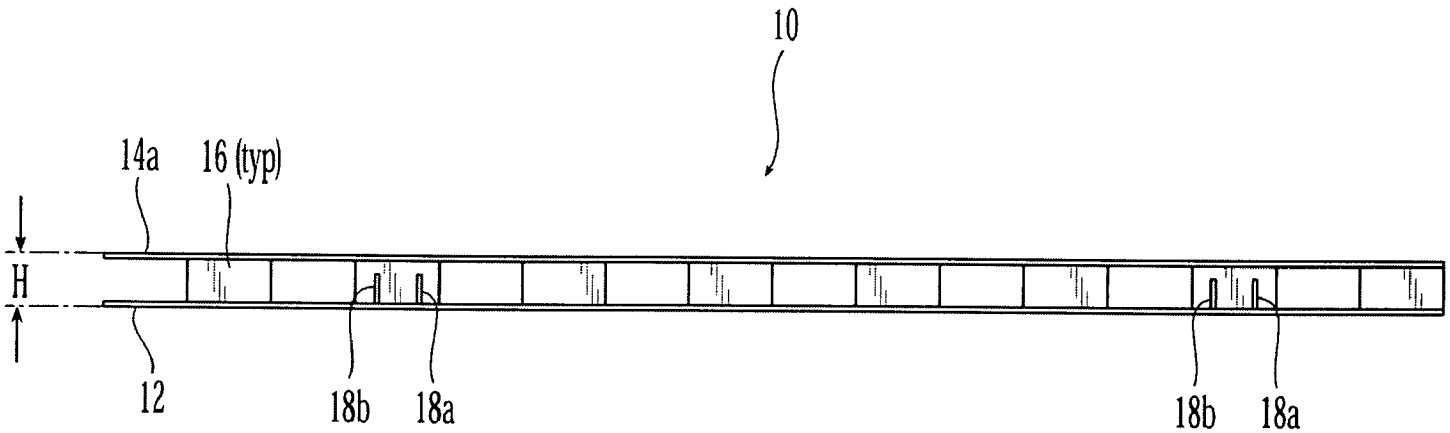
FIG. 6 is a side section view of the vent of FIG. 1, taken along line 5-5 of FIG. 4.

FIG. 5 shows an end view of the vent 10 in the deployed configuration, illustrating the deployed offset height "H" of the side rails 14*a, b*, as well as the resultant duct space 500 provided by the vent. Locking tabs 18*a, b* associated with the side rails 14*a, b* are also shown in their deployed, locking, configuration. FIG. 6 is a side view of the vent 10, again illustrating the deployed configuration with support members 16 engaged with locking tabs 18*a, b*.

In an alternative embodiment, a simplified vent 10 can be provided without side rails 14*a, b*. With this simplified design, support members 16 would directly engage the attic side 104 of the roof 100 when the vent is installed between rafters. From a manufacturing standpoint, such an arrangement would provide a simpler design as compared to the arrangement of FIG. 1, but it would also require the installer to individually fold out each support member 16 prior to installation. This would be a more time consuming process as compared to the embodiment of FIG. 1 in which all of the support members 16 on one side of the vent 10 are deployed simply by pulling up on the associated side rail 14.

One additional advantage to this simplified design is that an adjustable offset height feature could be provided. As shown in FIG. 3*a*, each support member 16 could be provided with a series of calibrated longitudinal perforation lines 16*a*, 16*b*, 16*c*, each labeled to correspond with a particular offset height (e.g. 1-½", 2", 3"). Upon installation, the user could simply fold up the support member 16 along the desired calibration line to provide the desired offset height between the roof 104 and the insulation batt 300. This arrangement would allow the manufacture of a single sized vent 10 which could then be used in a variety of applications.

FIGS. 2 and 2*a* show the vent 10 of FIG. 1 installed between adjacent rafters of a structure or building 400. Vent 10 is positioned to provide a vent passage from the soffit area 102 of the roof to the roof peak 440 of the building 400. The building can be an industrial or a residential building, including a home, office, and like structures. Building 400 has a generally horizontal ceiling 410 extends inwardly from wall 420. Roof rafters 430 extend upwardly from the wall 420 and ceiling 410 and support the roof sheathing or boards 102. The roof rafters 430 are, for example, on 12", 16" or 24" centers. Conventional roofing shingles can be attached to the top of the roof sheathing or boards 102. The structure has conventional openings between the roof sheathing 102, the ceiling 410, the wall 420 and adjacent the roof rafters 430 which provide for the movement of air from soffit area 102 to the roof peak 440. Soffit area 120 has a vent 106 for allowing air to move into the soffit area 120 from below the roof overhang. A vent 10 is installed between each insulation batt 300 and the attic side 104 of the roof 100 to provide a desired ventilation path from the soffit area 102 to the roof peak 440.

Air flow from the soffit 102 is illustrated by flow arrows, and can be seen entering the soffit vent 106 beneath the eaves, and traveling upward along the attic side 104 of the roof, between the roof and the insulation batt 300 until it reaches the roof peak 440.

To insulate a single rafter bay, multiple insulation batts are typically required and are placed in an end-to-end fashion. Accordingly, one vent 10 should be installed with each insulation batt, with the vents similarly being placed end-to-end along the rafter bay to create a substantially continuous ventilation duct between the batts and the roof, from the soffit area to the roof peak.

The vent and insulation batt 300 can be installed without special tools in new and existing structures, and the installation can be performed with a minimum of time and labor.

Accordingly, it should be understood that the embodiments disclosed herein are merely illustrative of the principles of the invention. Various other modifications may be made by those skilled in the art which will embody the principles of the invention and fall within the spirit and the scope thereof.

What is claimed is:

1. A vent for maintaining a space between insulation material and a roof structure, the vent comprising:

a bottom panel having first and second sides and a longitudinal axis, and a plurality of support legs associated with each side;

each support leg further comprising first and second ends, the first end being connected adjacent to a respective side of the bottom panel, and first and second longitudinally disposed side rails associated with the first and second sides of the bottom panel, wherein the bottom panel and side rails are connected to each other via the plurality of support legs;

wherein the support legs are connected to the bottom panel and the side rails along, respective longitudinal fold lines so that the vent, has a flattened configuration in which an upper surface of the bottom panel and an upper surface support legs are substantially parallel to one another, and a deployed configuration in which the upper surface of the bottom panel is substantially non-parallel to the upper surface of the support legs; and wherein a portion of the bottom panel extends between adjacent ones of the plurality of support legs such that when the vent is in the deployed configuration a plurality of lateral extensions extend laterally outward from the plurality of support legs toward the first and second sides, and wherein the plurality of lateral extensions extend beyond the plurality of support legs by a distance substantially equal to the distance between the first and second ends of the support legs.

2. The vent of claim 1, wherein when the vent is in the flattened configuration, an upper surface of the side rails is substantially parallel to the upper surfaces of the bottom panel and the support legs, and when the vent is in the deployed configuration, the upper surfaces of the bottom panel and the side rails are substantially parallel, to each other and are substantially nonparallel to the upper surfaces of the support members.

3. The vent of claim 1, wherein the bottom panel further comprises at least one opening when the vent is in the deployed configuration.

4. The vent of claim 1, wherein the bottom panel, support legs and side rails are formed from a single sheet of material.

5. The vent of claim 4, wherein the bottom panel, support legs and side rails are integrally connected to each other along the longitudinal fold lines.

6. The vent of claim 1, wherein the panels are formed from cardboard or extruded polystyrene (XPS).

7. The vent of claim 1, further comprising a locking tab associated with at least one support leg, the locking tab being positionable to inhibit movement of the vent from the deployed configuration to the flattened configuration.

8. The vent of claim 7, wherein the locking tab is integrally connected to the bottom panel along a laterally disposed fold line so that when the vent is in the deployed configuration, folding the tab along the fold line, presents an edge of the tab toward the roof-facing surface of the support leg, thus inhibiting the leg from folding toward a center of the bottom panel.

9. The vent of claim 1, wherein the bottom panel has a longitudinal dimension of about 48" and a lateral dimension of about 22-½" to conform to a similarly-sized insulation batt.

10. The vent of claim 1, wherein the support legs are sized to provide, an offset depth between the bottom panel and the side rails of from about 1" to about 3" when the vent is in the deployed configuration.

11. The vent of claim 1, wherein the support legs are sized to provide an offset between the bottom panel and the side rails of about 1-½" when the vent is in the deployed configuration.

12. The vent of claim 1, wherein the support legs provide a tactile response to the user during installation to signal engagement of the side rails with the roof structure.

13. The vent of claim 1, wherein the bottom panel comprises a breathable material.

14. The attic vent of claim 1, wherein the each of the plurality of support legs further has a second longitudinal fold line oriented parallel to the longitudinal fold line connecting the support legs to the bottom panel.

15. An attic vent for ventilating air under a roof between a soffit area of said roof and an attic space, said vent forming if duct with an attic facing side of said roof, said vent comprising:

a bottom panel having first and second sides and a bit longitudinal axis, a pair of longitudinally disposed first and second side rails, and a plurality of support legs associated with each side rail, each support leg having a first end foldably associated with one of the first and second sides and a second end foldably associated with one of the first and second side rails, wherein the vent has a flat configuration in which top surfaces of the support legs, side rails and bottom panel are coextensive with each ether, and a deployed configuration in which the top surface of the bottom panel is substantially parallel to, and offset from, the top surfaces of the side rails, the top surfaces of the side rails face away from the top surface of the bottom panel, and the top surface of the bottom panel is non-parallel to the top surface of each of the support legs; and wherein the bottom panel further comprises a locking tab associated with at least one support leg, the locking tab being positionable to inhibit movement of the vent from the deployed configuration to the flattened configuration.

16. The vent of claim 15, wherein the bottom panel comprises an openings configured to allow passage of moisture therethrough.

17. The vent of claim 16, wherein the bottom panel, support legs and side rails are formed from a single sheet of material.

18. The vent of claim 17, wherein the bottom panel, support legs and side rails are integrally connected to each other along the longitudinal fold lines.

19. The vent claim 15, wherein the panels are formed from cardboard or extruded polystyrene (XPS).

20. The vent of claim 15, wherein the locking tab is integrally connected to the bottom panel along a laterally disposed fold line so that when the vent is in the deployed configuration, folding the tab along the fold line presents an edge of the tab toward the top surface of the support leg, thus inhibiting the leg from folding toward a center of the bottom panel.

21. The vent of claim 15, wherein the bottom panel has a longitudinal dimension of about 48" and a lateral dimension of about 22-½" to conform to a similarly-sized insulation batt.

22. The vent of claim 15, wherein the support legs are sized to provide an offset depth between the bottom panel and the side rails of from about 1" to about 3" when the vent is in the deployed configuration.

23. The vent of claim 15, wherein the support legs are sized to provide an offset between the bottom panel and the side rails of about 1-½" when the vent is in the deployed configuration.

24. The vent of claim 15, wherein the support legs provide a tactile response to the user during installation to signal engagement of the side rails with the roof structure.

25. The attic vent of claim 15, wherein the bottom panel comprises a breathable material.

26. The attic vent of claim 15, wherein the each of the plurality of support legs further has an intermediate longitudinal fold line disposed between the first and second ends.

27. A foldable attic vent for maintaining a space between an insulation material and a roof structure, comprising:

a bottom panel having first and second sides, a longitudinal length and a planar surface;

first and second flanges for engaging an attic side of a said roof structure, said first and second flanges disposed laterally from said bottom panel arid connected thereto by at least first and second support legs, respectively, said first and second flanges disposed parallel to the longitudinal length of the bottom panel;

a tab member integral with the bottom panel, an edge of the tab member being detachable from the bottom panel along a fold line adjacent the first or second side, the fold lines oriented substantially perpendicular to the longitudinal length of the bottom panel;

said attic vent being provided in a first position, whereby said planar surface of said bottom panel, and upper surfaces of the first and second flanges and first and second support legs are approximately located within a common plane; and said attic vent being reconfigurable to a second position whereby said first and second support legs are folded upwardly from said common plane to present said first and second flanges in to higher plane which is offset to and substantially parallel with said common plane when said attic vent is installed;

wherein said tab member is positionable to contact the upper surface of the first or second support legs when the vent is in the second position to thereby prevent the first or second flange from returning to the first position.

28. The foldable attic vent of claim 27, wherein the bottom panel comprises a breathable material.

29. The foldable attic vent of claim 27, wherein the first and second support legs are connected to the bottom panel along respective first longitudinal fold lines, the first and second support legs further are connected, to the first and second flanges along respective second longitudinal fold lines, and each of the first and second support legs also has an intermediate longitudinal fold line disposed between the first and second fold lines.

* * * * *